US006792738B2

(12) United States Patent
Robinson

(10) Patent No.: US 6,792,738 B2
(45) Date of Patent: Sep. 21, 2004

(54) PACK WRAPPER OPENING SYSTEM

(76) Inventor: Douglas W. Robinson, 2317 Maricopa St., Torrance, CA (US) 90501

( * ) Notice: Subject to any disclaimer, the term of this patent is extended or adjusted under 35 U.S.C. 154(b) by 0 days.

(21) Appl. No.: 10/441,789

(22) Filed: May 20, 2003

(65) Prior Publication Data

US 2003/0192284 A1 Oct. 16, 2003

(51) Int. Cl.[7] ..... B65B 69/00

(52) U.S. Cl. ..... 53/381.2; 30/294; 407/29.1; 407/29.15; 414/412

(58) Field of Search ..... 53/396, 468, 492, 53/50, 381.2, 381.4, 382.1, 393, 381.1; 414/412, 811; 451/28, 523, 553, 557, 558, 524, 548, 552, 555, 913; 30/280, 290, 1, 2, 115, 314, 317, 291, 294; 407/29.1, 29.15; 29/76.1; 76/82–89

(56) References Cited

U.S. PATENT DOCUMENTS

| | | | | | |
|---|---|---|---|---|---|
| 94,503 | A | * | 9/1869 | Nicholson | 407/29.1 |
| 445,712 | A | * | 2/1891 | Dallis | 407/29.1 |
| 507,071 | A | * | 10/1893 | Huff | 407/29.1 |
| 721,843 | A | * | 3/1903 | Stepzinski | 76/83 |
| 1,083,297 | A | * | 1/1914 | Richardson | 407/29.1 |
| 3,791,014 | A | * | 2/1974 | Perna | 30/294 |
| 3,875,825 | A | * | 4/1975 | Buttafuoco | 76/83 |
| 3,887,973 | A | * | 6/1975 | Coon | 407/29.1 |
| 3,914,837 | A | * | 10/1975 | Coon | 407/29.1 |
| 4,423,571 | A | * | 1/1984 | Selander et al. | 451/528 |
| 4,598,447 | A | * | 7/1986 | Whyde | 407/29.1 |
| 4,941,246 | A | * | 7/1990 | Finnegan | 407/29.15 |
| 5,016,397 | A | * | 5/1991 | Higginbotham | 451/190 |
| 5,027,519 | A | * | 7/1991 | De Vincentis | 407/29.1 |
| 5,197,232 | A | * | 3/1993 | Ellestad | 451/558 |
| 5,333,381 | A | * | 8/1994 | Gelardi et al. | 30/2 |
| 5,426,895 | A | * | 6/1995 | Siciliano et al. | 451/523 |
| D366,407 | S | * | 1/1996 | Kendall et al. | D8/98 |
| 5,666,731 | A | * | 9/1997 | Rungren | 30/2 |
| 5,683,292 | A | * | 11/1997 | Young | 451/552 |
| 5,823,719 | A | * | 10/1998 | Tyler | 407/29.1 |
| 5,879,229 | A | * | 3/1999 | Anderson | 451/523 |
| D424,397 | S | * | 5/2000 | Wiseman | D8/98 |
| 6,171,177 | B1 | * | 1/2001 | Fitz | 451/523 |
| D477,520 | S | * | 7/2003 | McCracken | D8/98 |
| 2003/0019337 | A1 | * | 1/2003 | Hatanaka | 30/2 |

FOREIGN PATENT DOCUMENTS

| | | | | |
|---|---|---|---|---|
| WO | WO 87/00108 | * | 1/1987 | B24D/15/02 |

* cited by examiner

*Primary Examiner*—Stephen F. Gerrity
(74) *Attorney, Agent, or Firm*—Irving Keschner

(57) ABSTRACT

A system for removing a plastic wrapper from a package using a device including a horizontal panel having a planar upper surface and a planar lower surface. An abrasive sheet is secured to the planar upper surface of the horizontal panel. The package is rubbed against the abrasive sheet to tear and break the plastic wrapping so that it can be removed from the package.

4 Claims, 3 Drawing Sheets

PACK WRAPPER OPENING SYSTEM

BACKGROUND OF THE INVENTION

1. Field of the Invention

The present invention relates to a pack wrapper opening system and more particularly to a system that removes the plastic wrapper from a package for access to the contents of the package.

2. Description of the Prior Art

Most compact discs and cassettes are sold encased in a plastic wrapper. These plastic wrappers are often difficult to remove and tend to lead to frustration for those who are attempting to remove them. People often resort to using knives or other sharp objects to attempt to remove the wrappers. This sometimes results in damaging the package and also injury to themselves or others. What is needed is a device that will allow for the simple removal of these plastic wrappers so that the user can easily access the packages and the compact disc and cassettes that are stored within these packages.

The present invention solves these problems by providing a device that will allow for the easy removal of plastic wrappers from packages without the use of a knife or other sharp object.

The use of opening systems is known in the prior art. More specifically, opening systems heretofore devised and utilized for the purpose of removing wrappers from packages are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,666,731 to Rungren discloses a hand held device used to cut shrink wrap packages such as compact disc cases and is comprised of a cutting blade and guide assembly. U.S. Pat. No. 5,333,381 to Gelardi discloses a device for cutting tape on products such as video cassette boxes comprised of an angled blade device. U.S. Pat. No. 5,555,624 to McCracken discloses a pack opening system comprised of an edge guide and channel.

While these devices fulfill their respective, particular objective and requirements, the aforementioned patents do not describe a pack wrapper opening system for removing the plastic wrapper from a package for access to the contents of the package.

In this respect, the pack opening system according to the present invention departs from the conventional concepts and designs of the prior art, and in doing so provides an apparatus primarily developed for the purpose of safely removing the plastic wrapper from a package for access to the contents of the package.

Therefore, it can be appreciated that there exists a continuing need for new and improved pack wrapper opening system which can be used for removing the plastic wrapper from a package for access to the contents of the package. In this regard, the present invention substantially fulfills this need.

SUMMARY OF THE INVENTION

In view of the foregoing disadvantages inherent in the known types of opening systems now present in the prior art, the present invention provides an improved pack wrapper opening system and method which has all the advantages of the prior art and none of the disadvantages.

To ascertain this, the present invention essentially employs a device having a horizontal panel having a generally rectangular configuration. The horizontal panel is defined by a planar upper surface, a planar lower surface, opposed short end walls, and opposed long side walls. A pair of vertical panels are secured to and extend upwardly from the horizontal panel. Each of the vertical panels have a generally rectangular configuration. The vertical panels are defined by planar inner and outer surfaces, short opposed end walls, and long opposed end walls. Lower end walls of the vertical panels are secured to the opposed long side walls of the horizontal panel to define a receiving channel to receive a package between the vertical panels. An abrasive sheet having a series of conically shaped projections is secured to the planar upper surface of the horizontal panel in between the pair of vertical panels.

There has thus been outlined, rather broadly, the more important features of the invention in order than the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pack wrapper opening system which has all the advantages of the prior art opening systems and none of the disadvantages.

It is another object of the present invention to provide a new and improved pack wrapper opening system which may be easily and efficiently manufactured and marketed.

It is a further object of the present invention to provide a new and improved pack wrapper opening system which is of durable and reliable construction.

An even further object of the present invention is to provide a new and improved pack wrapper opening system that employs a device which is susceptible to a low cost of manufacture with regard to both materials and labor, and which accordingly is then susceptible to low prices of sale to the consuming public, thereby making such a pack wrapper opening system economically available to the buying public.

Even still another object of the present invention is to provide a new and improved pack wrapper opening system for removing the plastic wrapper from a package for access to the contents of the package.

Lastly, it is an object of the present invention to provide a new and improved pack wrapper opening system including a horizontal panel having a planar upper surface and a planar lower surface. An abrasive sheet having a series of conically shaped projections formed therein is secured to the planar upper surface of the horizontal panel. The projections are specifically shaped to allow plastic wrapping to be removed from a package without injuring the hands of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
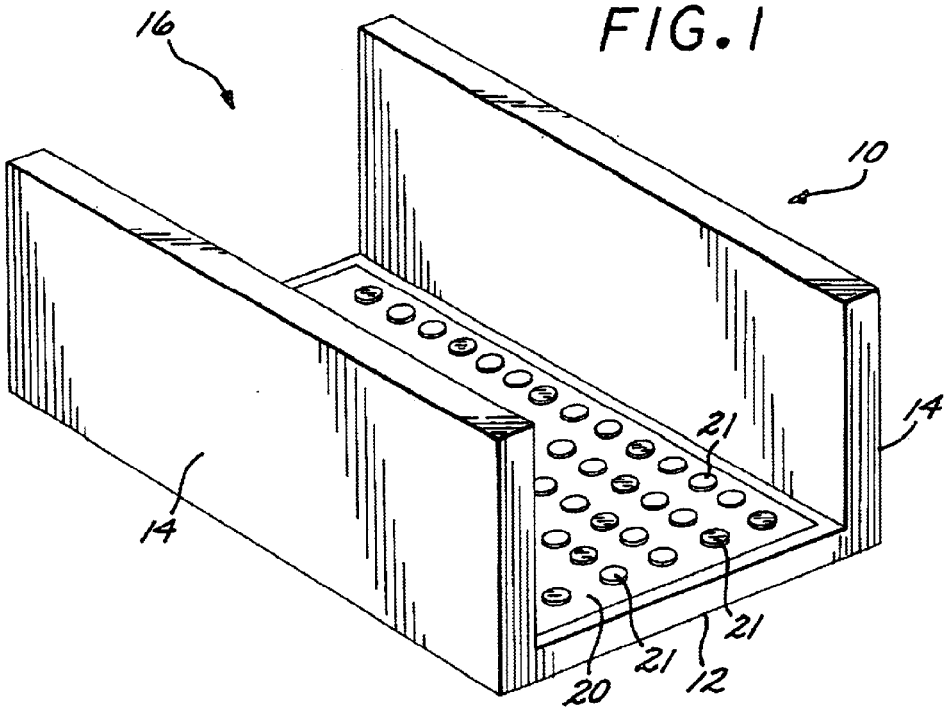
FIG. 1 is a perspective view of the preferred embodiment of the pack wrapper opening device constructed in accordance with the principles of the present invention.

With reference now to the drawings, and in particular, to FIGS. 1 through 4 thereof, the preferred embodiment of the new and improved pack wrapper opening system embodying the principles and concepts of the present invention and generally designated by the reference number 10 will be described.

Specifically, it will be noted in the various Figures that the invention employs a device for removing the plastic wrapper from a package for access to the contents of the package, wherein the device is used in accordance with the present invention to accomplish removal of the plastic wrapper from the package. In a broad context, the device consists of a horizontal panel, a pair of vertical panels, and an abrasive surface between the vertical panels. Such components are individually configured and correlated with respect to each other so as to attain the desired objective. Preferably, the horizontal panel 12 is fabricated from plastic.

The horizontal panel 12 has a generally rectangular configuration. The horizontal panel 12 is defined by a planar upper surface, a planar lower surface, opposed short end walls, and opposed long side walls.

The pair of vertical panels 14 are secured to and extend upwardly from the horizontal panel 12. Each of the vertical panels 14 have a generally rectangular configuration. The vertical panels 14 are defined by planar inner and outer surfaces, short opposed end walls, and long opposed end walls. Lower end walls of the vertical panels 14 are secured to the opposed long side walls of the horizontal panel 12 to define a receiving channel 16 for receiving a package 18 between the vertical panels.

The horizontal panel 12 has an abrasive surface, wherein an abrasive sheet 20 is secured to the planar upper surface of the horizontal panel 12 between the pair of vertical panels 14. In use, the package 18 is placed within the receiving channel 16 and engaged with the abrasive surface, and is slid along the abrasive surface formed by the abrasive sheet 20 so that the plastic wrapper 22 on the package 18 is broken and torn away from the package 18 by friction and the cutting action of the abrasive sheet 20. Thus, once the plastic wrapper 22 is cut, the rest of the plastic wrapper can be easily removed from the package 18 manually by the user. Sheet 20 comprises a metal sheet, or layer, secured to the planar upper surface of horizontal panel 12 and has a plurality of conically shaped projections 21 formed therein. Projections 21 are preferably formed by conventional punching techniques, the punching operation being initiated from the bottom surface of sheet 20 and completed before being completely punched through. The height of each projection 21 is in the range between 0.007 inches to about 0.008 inches; the spacing between each projection is approximately 0.1875 inches.

The specific dimensions and physical characteristics of the projections 21 are selected such that the packaging is removed without cutting or otherwise injuring the hands of a user. An abrasive sheet 20, having five rows, each row having eleven projections 21, has been successfully utilized.

Figure 4:
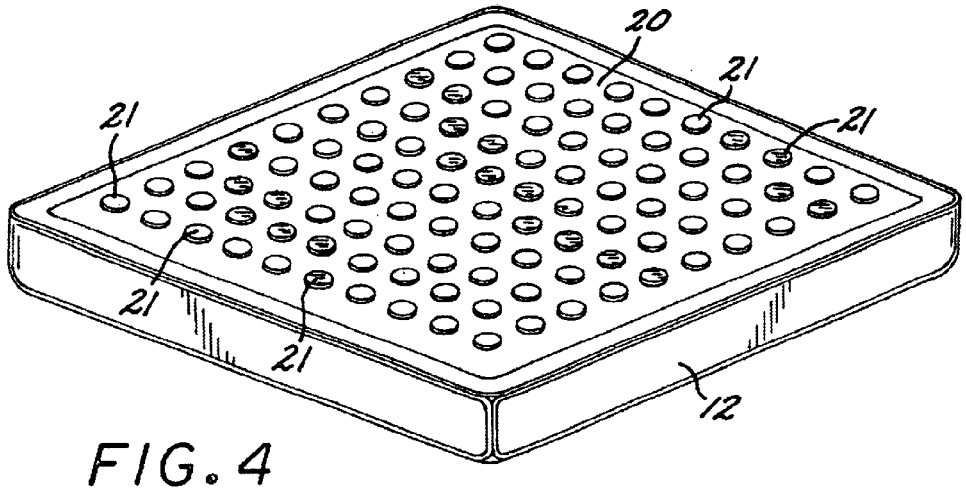
FIG. 4 is a perspective view of an alternate embodiment of the present invention.
Figure 2:
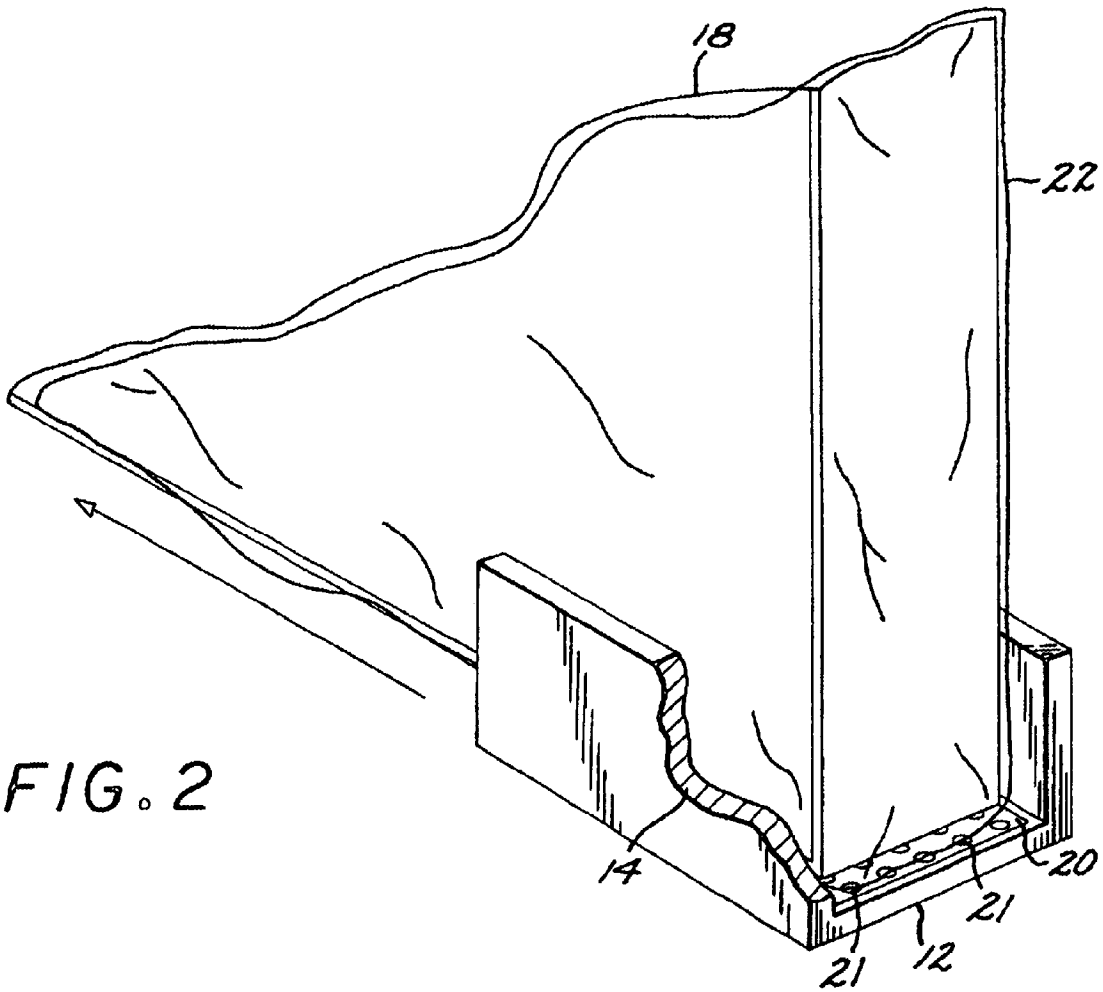
FIG. 2 is a perspective view of the present invention illustrated in use.
Figure 3:
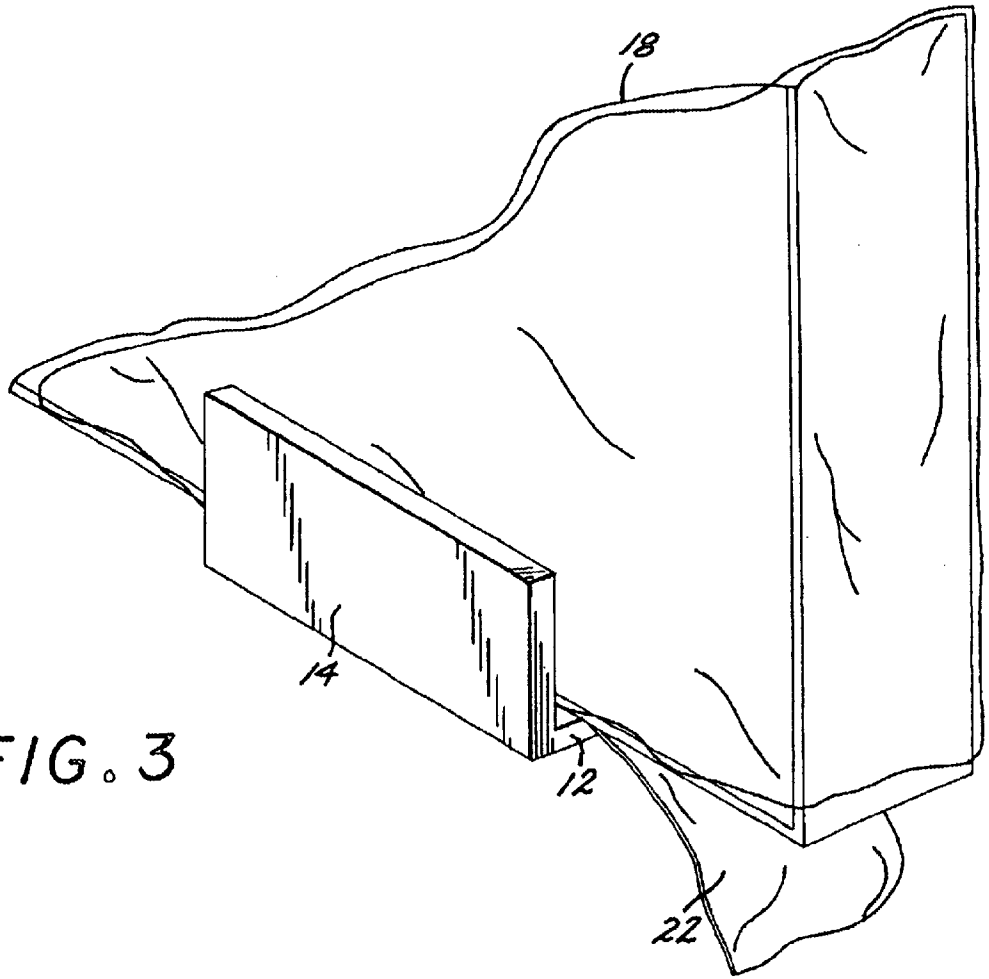
FIG. 3 is a perspective view of the present invention illustrated in use.

A second embodiment of the present invention is shown in FIG. 4 and includes substantially all of the components of the present invention shown in FIGS. 1-3 except that the vertical panels 14 have been removed and all that comprises the device 10 is the horizontal panel 12 and the abrasive sheet 20. This will allow the device 10 to be used on varying sized packages that are not dimensioned for being received between the vertical walls 14 in the preferred embodiment.

The present invention can be constructed in various sizes so that a hand held device 10 can be used as well as a larger version that can be placed on a table top for commercial uses.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed is:

1. A pack wrapper opening device for removing the wrapper from a package for access to the contents of the package comprising, in combination:

a horizontal panel having a generally rectangular configuration, the horizontal panel being defined by a planar upper surface, a planar lower surface, opposed short end walls, and opposed long side walls;

a pair of vertical panels secured to and extending upwardly from the horizontal panel, each of the vertical panels having a generally rectangular configuration, the vertical panels being defined by planar inner and outer surfaces, short opposed end walls, and long opposed end walls, lower end walls of the vertical panels being secured to the opposed long side walls of the horizontal panel to define a receiving channel to receive a package between the vertical panels, said receiving channel being of a predetermined width and length; and a metal sheet secured to the planar upper surface of the horizontal panel in between the pair of vertical panels, said sheet comprising a plurality of spaced projections extending along the width and length of said channel.

2. The device of claim 1 wherein said metal sheet is secured to the planar upper surface of the horizontal panel in between the pair of vertical panels.

3. The device of claim 1 wherein the spacing between said projections is approximately 0.1875 inches.

4. The device of claim 4 wherein the height of each projection is in the range between 0.007 inches and 0.008 inches.

* * * * *